US009016371B2

(12) United States Patent
Clem

(10) Patent No.: US 9,016,371 B2
(45) Date of Patent: Apr. 28, 2015

(54) FLOW RATE DEPENDENT FLOW CONTROL DEVICE AND METHODS FOR USING SAME IN A WELLBORE

(75) Inventor: Nicholas J. Clem, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 705 days.

(21) Appl. No.: 12/554,237

(22) Filed: Sep. 4, 2009

(65) Prior Publication Data

US 2011/0056686 A1 Mar. 10, 2011

(51) Int. Cl.
*E21B 43/04* (2006.01)

(52) U.S. Cl.
CPC ..... *E21B 43/04* (2013.01)

(58) Field of Classification Search
USPC ..... 166/51, 278, 155
See application file for complete search history.

(56) References Cited

U.S. PATENT DOCUMENTS

| | | | |
|---|---|---|---|
| 1,362,552 | A | 12/1920 | Alexander et al. |
| 1,649,524 | A | 11/1927 | Hammond |
| 1,915,867 | A | 6/1933 | Penick |
| 1,984,741 | A | 12/1934 | Harrington |
| 2,119,563 | A | 3/1937 | Wells |
| 2,089,477 | A | 8/1937 | Halbert |
| 2,214,064 | A | 9/1940 | Niles |
| 2,257,523 | A | 1/1941 | Combs |
| 2,412,841 | A | 12/1946 | Spangler |
| 2,762,437 | A | 1/1955 | Egan et al. |
| 2,810,352 | A | 10/1957 | Tumilson |
| 2,942,668 | A | 11/1957 | Maly et al. |
| 2,814,947 | A | 12/1957 | Stegemeier et al. |
| 2,942,541 | A | 7/1960 | Maly et al. |
| 3,326,291 | A | 6/1967 | Zandmer |
| 3,385,367 | A | 5/1968 | Kollsman |
| 3,419,089 | A | 12/1968 | Venghiattis |
| 3,451,477 | A | 6/1969 | Kelley |
| 3,675,714 | A | 7/1972 | Thompson |

(Continued)

FOREIGN PATENT DOCUMENTS

| | | |
|---|---|---|
| CN | 1385594 | 12/2002 |
| GB | 1492345 | 11/1977 |

(Continued)

OTHER PUBLICATIONS

Optimization of Commingled Production Using Infinitely Variable Inflow Control Valves; M.M, J. J. Naus, Delft University of Technology (DUT), Shell International Exploration and production (SIEP); J.D. Jansen, DUT and SIEP; SPE Annual Technical Conference and Exhibition, Sep. 26-29 Houston, Texas, 2004, Society of Patent Engineers.

(Continued)

*Primary Examiner* — Robert E Fuller
(74) *Attorney, Agent, or Firm* — Mossman, Kumar & Tyler PC

(57) ABSTRACT

An apparatus for performing a wellbore operation, such as a gravel packing, includes a tool body, a flow passage formed in the tool body, the flow passage connecting a first space with a second space; and a flow control device positioned along the flow space. The flow control device may include a valve element configured to allow uni-directional; and a flow control element configured to allow flow in bi-directional flow. The valve element and the flow control element may be arranged to form a split flow path between the first space and the second space.

8 Claims, 3 Drawing Sheets

(56) References Cited

U.S. PATENT DOCUMENTS 3,692,064 A 9/1972 Hohnerlein et al.
3,739,845 A 6/1973 Berry et al.
3,791,444 A 2/1974 Hickey
3,876,471 A 4/1975 Jones
3,918,523 A 11/1975 Stuber
3,951,338 A 4/1976 Genna
3,975,651 A 8/1976 Griffiths
3,987,854 A 10/1976 Callihan et al.
4,153,757 A 5/1979 Clark, III
4,173,255 A 11/1979 Kramer
4,187,909 A 2/1980 Erbstoesser
4,248,302 A 2/1981 Churchman
4,250,907 A 2/1981 Struckman et al.
4,257,650 A 3/1981 Allen
4,287,952 A 9/1981 Erbstoesser
4,428,428 A * 1/1984 Smyrl et al. ..... 166/278
4,434,849 A 3/1984 Allen
4,491,186 A 1/1985 Alder
4,497,714 A 2/1985 Harris
4,552,218 A 11/1985 Ross et al.
4,614,303 A 9/1986 Moseley, Jr. et al.
4,649,996 A 3/1987 Kojicic
4,974,674 A 12/1990 Wells
4,998,585 A 3/1991 Newcomer et al.
5,016,710 A 5/1991 Renard et al.
5,132,903 A 7/1992 Sinclair
5,156,811 A 10/1992 White
5,333,684 A 8/1994 Walter et al.
5,337,821 A 8/1994 Peterson
5,431,346 A 7/1995 Sinaisky
5,435,393 A 7/1995 Brekke et al.
5,435,395 A 7/1995 Connell
5,439,966 A 8/1995 Graham et al.
5,586,213 A 12/1996 Bridges
5,597,042 A 1/1997 Tubel et al.
5,609,204 A 3/1997 Rebardi et al.
5,673,751 A 10/1997 Head et al.
5,803,179 A 9/1998 Echols et al.
5,829,522 A 11/1998 Ross et al.
5,831,156 A 11/1998 Mullins
5,839,508 A 11/1998 Tubel et al.
5,873,410 A 2/1999 Iato et al.
5,881,809 A 3/1999 Gillespie et al.
5,896,928 A 4/1999 Coon
5,982,801 A 11/1999 Deak
6,065,535 A 5/2000 Ross
6,068,015 A 5/2000 Pringle
6,098,020 A 8/2000 Den Boer
6,112,815 A 9/2000 Boe
6,112,817 A 9/2000 Voll et al.
6,119,780 A 9/2000 Christmas
6,253,847 B1 7/2001 Stephenson
6,253,861 B1 7/2001 Charmichael et al.
6,273,194 B1 8/2001 Hiron et al.
6,305,470 B1 10/2001 Woie
6,338,363 B1 1/2002 Chen et al.
6,367,547 B1 4/2002 Towers
6,371,210 B1 4/2002 Bode et al.
6,419,021 B1 7/2002 George et al.
6,446,729 B1 * 9/2002 Bixenman et al. ..... 166/386
6,464,006 B2 * 10/2002 Womble ..... 166/276
6,505,682 B2 1/2003 Brockman
6,516,888 B1 2/2003 Gunnarson et al.
6,581,682 B1 6/2003 Parent et al.
6,622,794 B2 9/2003 Zisk, Jr.
6,679,324 B2 1/2004 Den Boer et al.
6,786,285 B2 9/2004 Johnson et al.
6,789,623 B2 * 9/2004 Hill et al. ..... 166/278
6,817,416 B2 11/2004 Wilson et al.
6,840,321 B2 1/2005 Restarick et al.
6,857,476 B2 2/2005 Richards
6,863,126 B2 3/2005 McGlothen et al.
6,938,698 B2 9/2005 Coronado
6,951,252 B2 10/2005 Restarick et al.
6,976,542 B2 12/2005 Henriksen et al.
7,011,076 B1 3/2006 Weldon et al.
7,128,151 B2 10/2006 Corbett
7,185,706 B2 3/2007 Freyer
7,290,606 B2 11/2007 Coronado et al.
7,322,412 B2 1/2008 Badalamenti et al.
7,325,616 B2 2/2008 Lopez De Cardenas
7,331,388 B2 * 2/2008 Vilela et al. ..... 166/278
7,395,858 B2 7/2008 Barbosa et al.
7,409,999 B2 8/2008 Henrikson et al.
7,469,743 B2 12/2008 Richards
7,673,678 B2 3/2010 MacDougall et al.
7,950,454 B2 * 5/2011 Patel et al. ..... 166/278
2002/0020527 A1 2/2002 Kilaas et al.
2003/0221834 A1 12/2003 Hess et al.
2004/0069489 A1 4/2004 Corbett
2004/0140089 A1 * 7/2004 Gunneroed ..... 166/228
2004/0144544 A1 7/2004 Freyer
2004/0194971 A1 10/2004 Thomson
2005/0016732 A1 1/2005 Brannon et al.
2005/0082060 A1 * 4/2005 Ward et al. ..... 166/278
2005/0126776 A1 6/2005 Russell
2005/0178705 A1 8/2005 Broyles et al.
2005/0189119 A1 9/2005 Gynz-Rekowski
2005/0199298 A1 9/2005 Farrington
2005/0207279 A1 9/2005 Chemali et al.
2005/0241835 A1 11/2005 Burris et al.
2006/0042798 A1 3/2006 Badalamenti et al.
2006/0048936 A1 3/2006 Fripp et al.
2006/0048942 A1 3/2006 Moen et al.
2006/0076150 A1 4/2006 Coronado et al.
2006/0086498 A1 4/2006 Wetzel et al.
2006/0108114 A1 5/2006 Johnson
2006/0175065 A1 8/2006 Ross
2006/0185849 A1 8/2006 Edwards et al.
2006/0272814 A1 12/2006 Broome et al.
2006/0273876 A1 12/2006 Pachla et al.
2007/0012444 A1 1/2007 Horgan et al.
2007/0039741 A1 2/2007 Hailey, Jr.
2007/0044962 A1 3/2007 Tibbles
2007/0068675 A1 * 3/2007 Barry et al. ..... 166/278
2007/0131434 A1 6/2007 MacDougall et al.
2007/0246210 A1 10/2007 Richards
2007/0246213 A1 10/2007 Hailey, Jr.
2007/0246225 A1 10/2007 Hailey, Jr. et al.
2007/0246407 A1 10/2007 Richards et al.
2007/0272408 A1 11/2007 Zazovsky et al.
2008/0035349 A1 2/2008 Richard
2008/0035350 A1 2/2008 Henriksen
2008/0053662 A1 3/2008 Williamson et al.
2008/0099194 A1 * 5/2008 Clem ..... 166/51
2008/0135249 A1 6/2008 Fripp et al.
2008/0149323 A1 6/2008 O'Malley et al.
2008/0149351 A1 6/2008 Marya et al.
2008/0236839 A1 10/2008 Oddie
2008/0236843 A1 10/2008 Scott et al.
2008/0283238 A1 11/2008 Richards et al.
2008/0296023 A1 12/2008 Willauer
2008/0314590 A1 12/2008 Patel
2009/0133869 A1 5/2009 Clem
2009/0133874 A1 5/2009 Dale et al.
2009/0139727 A1 6/2009 Tanju et al.
2009/0205834 A1 8/2009 Garcia et al.

FOREIGN PATENT DOCUMENTS

GB 2341405 12/2007
JP 59089383 6/1984
SU 1335677 A 9/1987
WO WO 94/03743 2/1994
WO WO 00/79097 5/2000
WO WO 01/65063 2/2001
WO WO 01/77485 3/2001
WO WO02/075110 9/2002

(56) References Cited

FOREIGN PATENT DOCUMENTS

| | | |
|---|---|---|
| WO | WO2004/018833 A1 | 3/2004 |
| WO | WO2006/015277 | 2/2006 |

OTHER PUBLICATIONS

An Oil Selective Inflow Control System; Rune Freyer, Easy Well Solutions; Morten Fejerskkov, Norsk Hydro; Arve Huse, Altinex; European Petroleum Conference, Oct. 29-31, Aberdeen, United Kingdom, Copyright 2002, Society of Petroleum Engineers, Inc.

Determination of Perforation Schemes to Control Production and Injection Profiles Along Horizontal; Asheim, Harald, Norwegian Institute of Technology; Oudeman, Pier, Koninklijke/Shell Exploratie en Producktie Laboratorium; SPE Drilling & Completion, vol. 12, No. 1, March; pp. 13-18; 1997 Society of Petroleum Engineers.

* cited by examiner

FLOW RATE DEPENDENT FLOW CONTROL DEVICE AND METHODS FOR USING SAME IN A WELLBORE

CROSS-REFERENCE TO RELATED APPLICATIONS

None.

BACKGROUND OF THE DISCLOSURE

1. Field of the Disclosure

The present invention relates to fluid flow control for downhole tools.

2. Description of the Related Art

Control of fluid circulation can be of operational significance for numerous devices used in oil and gas wells. One illustrative example is a gravel packing tool used for gravel packing operations. In general, gravel packing includes the installation of a screen adjacent a subsurface formation followed by the packing of gravel in the perforations and around the screen to prevent sand from migrating from the formation to the production tubing. Usually, a slurry of gravel suspended in a viscous carrier fluid is pumped downhole through the work string and a cross-over assembly into the annulus. Pump pressure is applied to the slurry forcing the suspended gravel through the perforations or up against the formation sand. The gravel then accumulates in the annulus between the screen and the casing or the formation sand. The gravel forms a barrier which allows the in-flow of hydrocarbons but inhibits the flow of sand particles into the production tubing. Afterwards, a clean-up operation may be performed wherein a cleaning fluid is reverse circulated through the well to clean the tools of slurry and leaving only the gravel pack surrounding the screens behind.

The present disclosure provides methods and devices for controlling fluid circulation during gravel packing operations. The present disclosure also provides for controlling fluid circulation in other wellbore-related operations.

SUMMARY OF THE DISCLOSURE

In aspects, the present disclosure provides an apparatus for completing a well. The apparatus may include a tool configured have a first flow path in a first position and a second flow path in a second position. Each flow path allows fluid flow. The first flow path may include at least a port coupling the upper bore to a lower annulus surrounding the tool, a lower bore of the tool in communication with the lower annulus, and a mechanically static and bi-directional flow passage connecting the lower bore with an upper annulus surrounding the tool. The second flow path may include at least a first branch having the port coupling the upper annulus to the upper bore; and a second branch having a mechanically static and bi-directional flow passage coupling the upper annulus to the lower bore.

In aspects, the present disclosure also provides a method for completing a well using a tool disposed in the well. The method may include flowing a gravel slurry through an upper bore of the tool, a port coupling the upper bore to a lower annulus surrounding the tool, a lower bore of the tool in communication with the lower annulus, and a mechanically static and bi-directional flow passage connecting the lower bore with an upper annulus surrounding the tool; and flowing a cleaning fluid through a port coupling the upper annulus to the upper bore, and through a mechanically static and bi-directional flow passage coupling the upper annulus to the lower bore.

In still further aspects, the present disclosure provides a system for completing a well. The system may include a tool having an upper bore, a lower bore, and a port providing fluid communication between the upper bore and an exterior of the tool; a valve member selectively isolating the upper bore from the lower bore; a flow path formed in the tool, the flow path providing fluid communication between an exterior of the tool and the lower bore. The flow path may include a mechanically static and bi-directional flow passage.

It should be understood that examples of the more illustrative features of the disclosure have been summarized rather broadly in order that detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

The advantages and further aspects of the disclosure will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE PREFERRED EMBODIMENTS

Figure 1:
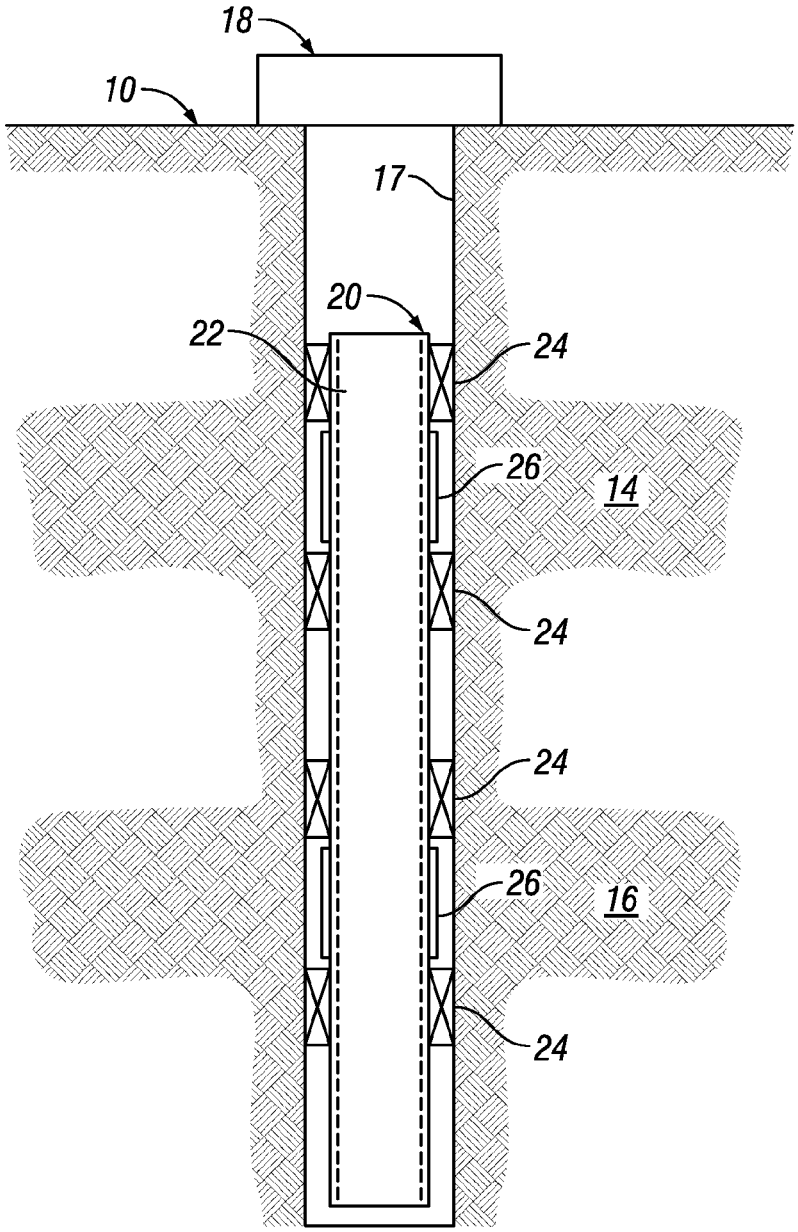
FIG. 1 is a schematic elevation view of an exemplary production assembly.

The present disclosure relates to devices and methods for controlling fluid flow in downhole tools. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein.

Referring initially to FIG. 1, there is shown an exemplary well 10 that has been drilled into formations 14, 16 from which it is desired to produce hydrocarbons. The wellbore 10 is cased by metal casing 17, as is known in the art, and a number of perforations (not shown) penetrate and extend into the formations 14,16 so allow for in-flow of production fluids. The wellbore 10 may include a production assembly, generally indicated at 20. Also, in certain situations, a tubing string (not shown) may extend downwardly from a wellhead 18 to the production assembly 20. The production assembly 20 may be configured to control flow between the well 10 (FIG.

1) and the formations 14, 16 (FIG. 1). The production assembly 20 may include a production tubular 22, isolation elements 24, and one or more filtration elements 26. In one embodiment, the sealing members 24 may be packer elements that provide zonal isolation. The filtration element 26 may be a screen element that permits fluid flow into the tubular 22 while removing particles of a predetermined size from the in-flowing fluid.

For ease of explanation, embodiments of the present disclosure will be described in connection with a flow control device associated with a gravel pack tool. It should be understood, however, that the teachings of the present disclosure may be utilized in connection with any downhole tool that utilizes flow control devices.

Figure 2:
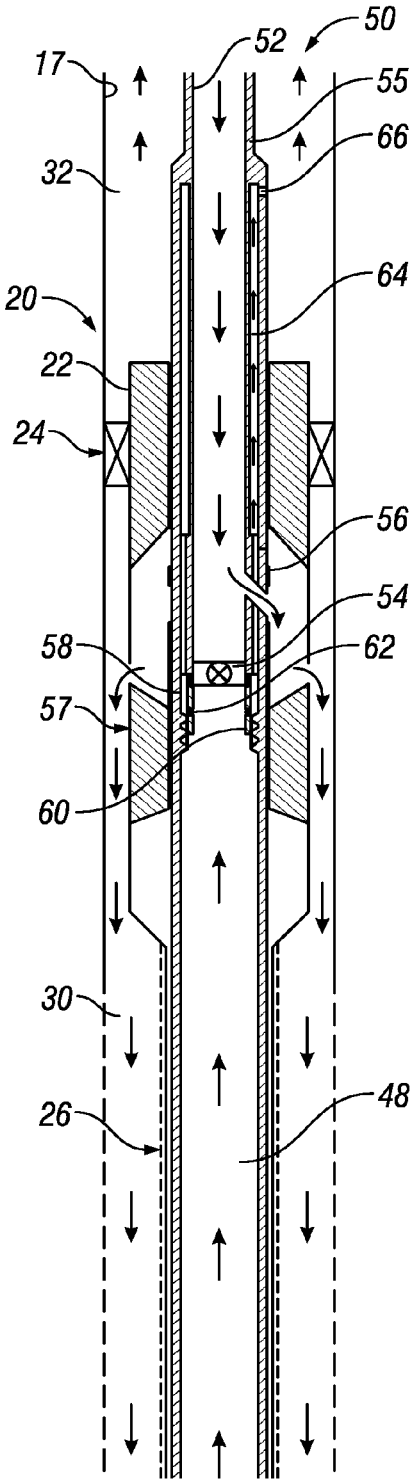
FIG. 2 is a schematic cross-sectional view of a gravel pack tool that uses an exemplary flow control element made in accordance with one embodiment of the present disclosure.

Referring now to FIG. 2, there is shown a production assembly 20 and a gravel pack tool 50. The gravel pack tool 50 may be configured to deliver a granular material (or "gravel") into the annular space 30 separating the filtration element 26 and the wall of the well 10. In some embodiments, the wall may be the casing 17. In other embodiments, the wall may be a rock face, i.e., an open hole. In one embodiment, the tool 50 may include a bore 52, a valve 54 that selectively occludes the bore 52, and a cross over tool 55 that has a cross over port 56 that allows fluid flow between the bore 52 and the exterior of the tool 50. One or more seal bores 57 may be used to channel fluid flow from the cross over tool 55 to the lower annulus 30. As shown, the sealing member 24 isolates a lower annular zone 30 from an upper annular zone 32. The tool 50 may also include a flow control device 58 that control flow between a lower bore 48 and the exterior of the tool 50. The flow control device 58 may communicate with one or more axially aligned channels 64 that terminate at one or more ports 66. The lower bore 48 may be a bore of the production tubular 22 or the gravel pack tool 50.

Figure 3:
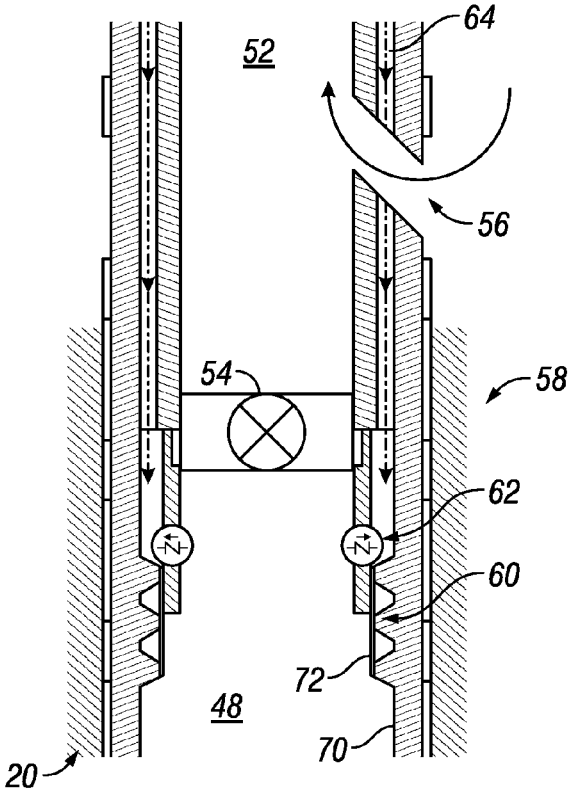
FIG. 3 schematically illustrates a flow control device made in accordance with one embodiment of the present disclosure.

Referring now to FIG. 3, there is shown in greater detail the flow control device 58 and related elements. In one embodiment, the flow control device includes a mechanically static and bi-directional flow control element 60 and a valve element 62. The flow control element 60 and the valve element 62 may split the fluid into two separate flow paths such that fluid may flow through either or both of elements 60, 62. The term split does not require any particular ratio. The splitting may result in even or uneven flow rates across the flow control element 60 and the valve element 62. In the electrical sense, the separate flow paths may be considered parallel because the two flow paths receive fluid from the same source and flow the fluid into a common point. Of course, some embodiments may utilize more than two separate flow paths. Additionally, it should be understood that the flow does not necessarily remain separated until the fluid reaches the upper annular zone 32. That is, the fluids flowing separately through the flow control element 60 and the valve element 62 may rejoin in an annular space or cavity and then enter the axially aligned channel(s) 64. Thus, the fluid path between the lower bore 48 and the upper annular zone 32 may have a first section with split flow and then a second section with combined flow.

By mechanically static, it is generally meant that the flow control element 60 does not substantially change in size or shape or otherwise change in configuration during operation. In contrast, a mechanically dynamic device may include a flapper valve, a multi-position valve, a ball valve and other devices that can, for example, change a size of a cross sectional flow area during operation. Thus, in aspects, the term mechanically static includes structures that have a fixed dimension, orientation, or position during operation. In some arrangements, the flow control element 60 may include helical channels, orifices, grooves and other flow restricting conduits. In embodiments, the length and configuration of the helical channels may be selected to apply an amount of frictional losses in order to generate a predetermined amount of back pressure along the flow control device 58. In an embodiment, the shape and diameter of an orifice or orifices may be selected to reduce a cross-sectional flow area such that a desired predetermined amount of back pressure is generated in the flow control device 58. These flow paths may be formed on an inner surface 70 of the tool 50. A sleeve 72 may be used to enclose and seal the flow paths such that fluid is forced to flow along these flow paths. These features may be configured to generate a specified pressure drop such that a back pressure is applied to the channels 64. The applied back pressure forces the fluid to flow into the upper bore 52 as described in greater detail below. The valve element 62 may be a one-way valve configured to allow flow from the lower bore 48 and block flow from channels 64, i.e., uni-directional flow. The valve element 62 may also utilize a biased piston that opens when a preset pressure differential is present between the bore 48 and the channels 64; e.g., a pressure in the bore 48 that exceeds the pressure in the channels 64 by a preset value.

In the circulation mode, the tool 50 is positioned inside the production assembly 20. After the seal bore 57 has been activated, surface pumps may pump slurry down the bore 52 of the gravel pack tool 50. The slurry flows through the cross over port 56 and into the lower annulus 30. The slurry may include a fluid carrier such as water, oil, brine, epoxies or other fluids formulated to convey entrained solids or semi-solids. The fluid component of the slurry flows through the filtration elements 26 and into the lower bore 48. The solid or particulated components of the slurry pack into the lower annulus 30. The fluid component flows up the lower bore 48 and through the flow control device 58. Due to the relatively low fluid velocity, the fluid component may flow across both the valve element 62 and the flow control element 60. Thereafter, the fluid components flow to the surface via the channels 64, the ports 66, and the upper annulus 32. This circulation is maintained until a sufficient amount of particles, e.g., gravel, have been deposited into the lower annulus 30. Thus, during a circulation mode, the tool 50 is positioned and configured to have a specified flow path for the gravel slurry material. As used herein, the term "flow path" refers to a structure that allows fluid to flow through rather than collect.

Figure 4:
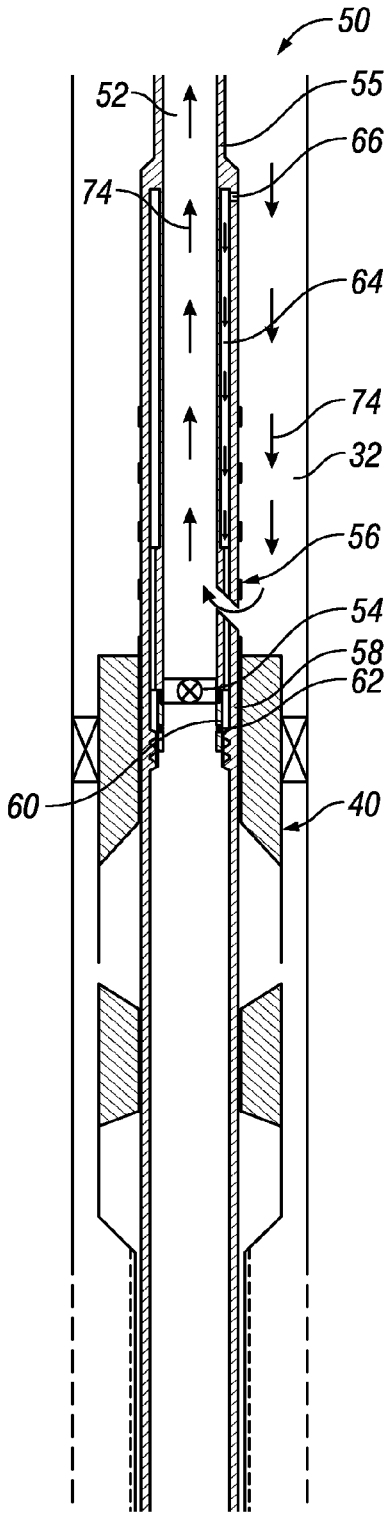
FIG. 4 schematically illustrates a flow control device made in accordance with one embodiment of the present disclosure that is positioned for reverse circulation.
Figure 5:
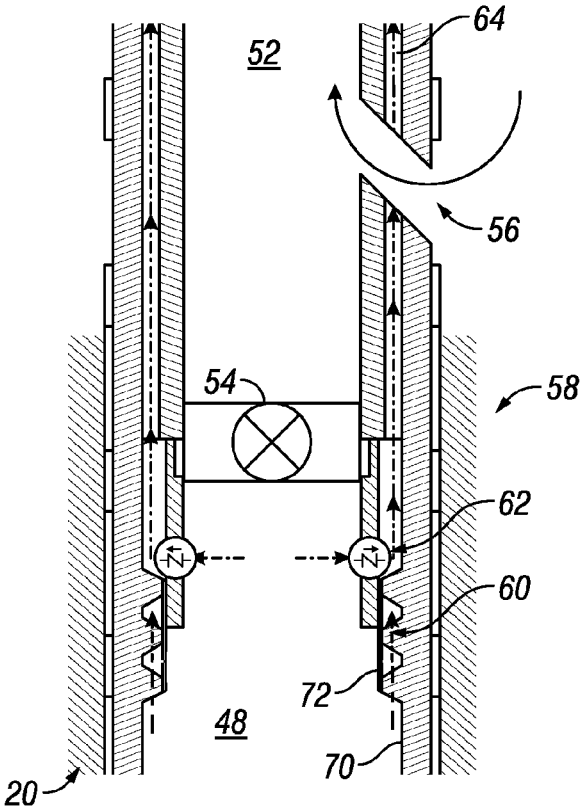
FIG. 5 schematically illustrates a split flow i between a valve port and a bi-directional flow passage.

Referring now to FIG. 4, after the packing operation is completed, the gravel pack tool 50 is shifted uphole such that the cross over port 56 is positioned to communicate with the upper annulus 32 while the valve 54 is positioned to block fluid communication into the production assembly 20. In this configuration, a reverse circulation may be performed to clean the bore 52 of slurry. For example, a cleaning fluid 74 (e.g., a liquid such as water or brine) is pumped down via the upper annulus 32. This fluid enters the bore 52 via the cross over port 56. Thereafter, the cleaning fluid flows up the bore 52 to the surface. During this reverse circulation, the cleaning fluid also flows into the ports 66 and downwardly through the channels 64 to the flow control device 58. That is, the cross over port 56 and the ports 66 may split the fluid into two separate flow paths, with one path leading to the upper bore 52 and another path leading to the lower bore 48. The term split does not require any particular ratio and may result in even or uneven flow rates across the cross over port 56 and the ports 66. Thus, during a cleaning mode, the tool 50 is re-positioned to have a different flow path from the circulation flow path.

The valve element 62 may be configured to prevent fluid flow during reverse circulation, which then forces the fluid to flow across the flow control element 60. Because a relatively high fluid flow rate is used during reverse circulation, the flow control element 60 generates a back pressure across the channels 64 which acts to restrict fluid flow. Thus, most of the fluid passes through the cross over port 56. In other situations, the valve element 62 may intentionally or inadvertently fail to close. In such situations, the flow control element 60 still provides a mechanism to generate a back pressure in the passages 64. Reverse circulation is maintained until the bore 52 and other downhole components are cleaned of slurry. It should be understood that in certain embodiments, the valve element 62 may be omitted.

In embodiments, the slurry is circulated at a slower flow rate than the cleaning fluid. Because of the higher flow rate of the cleaning fluid, a greater back pressure is generated by the flow control element 62.

After reverse circulation has been completed, the gravel pack tool 50 may be repositioned at another location in the wellbore to perform a subsequent gravel pack operation. For example, the tool 50 may be moved from the formation 14 to the formation 16. Each subsequent operation may be performed as generally described previously. It should be appreciated that as the gravel pack tool 50 is pushed into the well 10, the fluid residing in the well 10 can bypass the valve 54 via the flow control element 60. Thus, "surge" effect can be minimized. Surge effect is a pressure increase downhole of a moving tool caused by an obstruction in a bore. Also, as the tool 50 is pulled out of the well, the fluid uphole of the tool 50 can by bypass the valve 54 via the flow control element 60. Thus, "swab" effect can be minimized. Swab effect is a pressure decrease downhole of a moving tool caused by an obstruction in a bore.

As stated previously, the teachings of the present disclosure may be utilized in connection with any downhole tool that utilizes flow control devices. Such flow control devices may be used in connection with tools that set packers, slips, perform pressure tests, etc. Also, such flow control devices may be used in drilling systems.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

I claim:

1. An apparatus for completing a well, comprising:

a tool having an upper bore and a lower bore, the tool being configured to have a first flow path in a first position and a second flow path in a second position, each flow path allowing fluid flow, and wherein:

(i) the first flow path includes at least a port coupling the upper bore to a lower annulus surrounding the tool, the lower bore in communication with the lower annulus, a mechanically static and bi-directional flow passage and at least one channel connecting the lower bore with an upper annulus surrounding the tool, wherein a valve element blocks flow from the at least one channel to the lower bore via the valve element;

(ii) the second flow path includes at least a first branch wherein the port couples the upper annulus to the upper bore; and a second branch wherein the mechanically static and bi-directional flow passage and the at least one channel couple the upper annulus to the lower bore, wherein the valve element permits flow from the lower bore into the at least one channel via the valve element; and a valve selectively occluding the upper bore from the lower bore, and wherein the mechanically static and bi-directional flow passage and the valve element split fluid flowing from the lower bore such that the fluid has two separate flow paths to the upper annulus and around the valve.

2. The apparatus of claim 1 wherein the mechanically static and bi-directional flow passage is configured to generate a back pressure along the at least one channel.

3. The apparatus of claim 2, wherein the mechanically static and bi-directional flow passage includes a flow space selected from a group consisting of (i) at least one helical channel generating the back pressure using frictional losses, and (ii) an orifice generating the back pressure using a reduction in flow area.

4. The apparatus of claim 1 further comprising: (i) a supply of gravel slurry coupled to the upper bore when the tool is in the first position, and (ii) a supply of a cleaning fluid coupled to the upper annulus when the tool is in the second position.

5. A method for completing a well using a tool disposed in the well, the method comprising:

positioning a tool in the well, the tool having an upper bore and a lower bore, the tool being configured to have a first flow path in a first position and a second flow path in a second position, each flow path allowing fluid flow, and wherein:

(i) the first flow path includes at least a port coupling the upper bore to a lower annulus surrounding the tool, the lower bore in communication with the lower annulus, and a mechanically static and bi-directional flow passage and at least one channel connecting the lower bore with an upper annulus surrounding the tool, wherein a valve element blocks flow from the at least one channel to the lower bore via the valve element;

(ii) the second flow path includes at least a first branch wherein the port couples the upper annulus to the upper bore; and a second branch wherein the mechanically static and bi-directional flow passage and the least one channel couple the upper annulus to the lower bore, wherein the valve element permits flow from the lower bore into the at least one channel via the valve element; and (iii) a valve selectively occluding the upper bore from the lower bore, and wherein the mechanically static and bi-directional flow passage and the valve element split fluid flowing from the lower bore such that the fluid has two separate flow paths to the upper annulus and around the valve;

flowing a gravel slurry through the first flow path; and flowing a cleaning fluid through the second flow path, wherein the cleaning fluid flow in the mechanically static and bi-directional flow passage generates a back pressure to divert fluid to the port.

6. The method of claim 5, wherein the mechanically static and bi-directional flow passage includes a flow space selected from a group consisting of (i) at least one helical channel generating the back pressure using frictional losses, and (ii) an orifice generating the back pressure using a reduction in flow area.

7. The method of claim 5, wherein the back pressure is generated along the at least one channel.

8. The method of claim 5 further comprising moving the tool after flowing the gravel slurry but before flowing the cleaning fluid.

* * * * *